US006030353A

United States Patent [19]

Van Brunt

[11] Patent Number: 6,030,353

[45] Date of Patent: Feb. 29, 2000

[54] PNEUMATIC CHEST COMPRESSION APPARATUS

[75] Inventor: Nicholas P. Van Brunt, White Bear Lake, Minn.

[73] Assignee: American Biosystems, Inc., St. Paul, Minn.

[21] Appl. No.: 09/067,692

[22] Filed: Apr. 28, 1998

[51] Int. Cl.[7] ..... A61H 7/00; A61H 19/00

[52] U.S. Cl. ..... 601/150; 601/151; 601/148; 239/431

[58] Field of Search ..... 601/41, 43, 44, 601/48, 148, 149, 150, 151, 152, 6, 55, 76, 77; 606/202; 602/13; 237/46, 50; 239/429, 430, 431, 433, 434, 434.5

[56] References Cited

U.S. PATENT DOCUMENTS

| | | | |
|---|---|---|---|
| 3,063,444 | 11/1962 | Jobst . | |
| 3,536,063 | 10/1970 | Werding . | |
| 3,742,899 | 7/1973 | Alperin et al. | 118/2 |
| 3,896,794 | 7/1975 | McGrath . | |
| 3,905,651 | 9/1975 | Hornung | 303/2 |
| 3,993,053 | 11/1976 | Grossan . | |
| 4,133,305 | 1/1979 | Steuer . | |
| 4,175,297 | 11/1979 | Robbins et al. | 5/284 |
| 4,311,135 | 1/1982 | Brueckner et al. | 601/152 |
| 4,815,452 | 3/1989 | Hayek . | |
| 4,838,263 | 6/1989 | Warwick et al. . | |
| 4,873,937 | 10/1989 | Binder et al. | 118/44 |
| 4,921,408 | 5/1990 | Kvinge et al. | 417/368 |
| 4,977,889 | 12/1990 | Budd . | |
| 5,056,505 | 10/1991 | Warwick et al. . | |
| 5,173,325 | 12/1992 | Knobbe et al. | 427/476 |
| 5,402,938 | 4/1995 | Sweeney | 239/431 |
| 5,453,081 | 9/1995 | Hansen . | |
| 5,575,762 | 11/1996 | Peeler et al. | 601/152 |
| 5,606,754 | 3/1997 | Hand et al. . | |
| 5,840,049 | 11/1998 | Tumey et al. | 601/149 |

OTHER PUBLICATIONS

No author listed, EXAIR Catalog No. 96A, 1996, pp. 29–34, EXAIR Corporation, 1250 Century Circle North, Cincinnati, OH 45246.

*Primary Examiner*—Richard J. Apley
*Assistant Examiner*—Justine R. Yu
*Attorney, Agent, or Firm*—David B. Edgeworth

[57] ABSTRACT

A multi-function pneumatic chest compression apparatus provides various functions useful in both clinical and treatment environments, including mucous mobilization, breathing assistance, exhaled gas composition, and others. An air flow generator produces preselected air flows depending on the function(s) selected. These air flows are delivered to a bladder positioned about the patient. A controller receives feedback from the bladder and manipulates a valve controlling the flow of air into the air flow generator based on the feedback and preselected operating parameters.

22 Claims, 2 Drawing Sheets

PNEUMATIC CHEST COMPRESSION APPARATUS

BACKGROUND OF THE INVENTION

The present invention relates to a medical device, namely, an apparatus for generating air pulses to be delivered to the chest of a patient for treatment and diagnostic purposes.

It has been recognized that applying pneumatic pressure to the chest wall of a patient has both diagnostic and treatment applications. Typically, a bladder or other type of air-receiving chamber is positioned about the chest of a patient. An air flow generating system is coupled with the bladder. The air flow generating system selectively controls the air pressure in the bladder to provide the desired compressions of the patient's chest.

One application of applying pneumatic pressure to a patient's chest is breathing assistance. A patient may not require a ventilator, yet need some assistance for adequate breathing. For example, a patient may be able to inhale, but not fully exhale. A bladder and air flow generating system is coupled with a system for detecting the breathing cycle, i.e., exhalation and inhalation. When the patient's exhale cycle is detected, a controlled air pulse is delivered to the bladder, "squeezing" the patient's chest to provide a greater exhalation. The air flow generating system then reduces the bladder pressure, allowing the patient to freely inhale on the next breathing cycle.

Pneumatic chest compression is also used for airway mucous mobilization. For example, high frequency chest compressions are used as a treatment to clear the airways of cystic fibrosis patients, see, e.g., U.S. Pat. Nos. 5,453,081, 5,056,505, and 4,838,263, incorporated herein by reference. Airway mucous mobilization may also be useful in the therapy regime of other respiratory ailments, including emphysema, asthma, and chronic bronchitis. Additionally, mucous mobilization may also be useful in diagnostic applications. For example, there is some indication that early stages of lung cancer may be detected by analyzing cell material in a patient's mucous. Enhanced mucous mobilization using chest compressions may generate better mucous samples and, consequently, better cancer detection opportunities.

Pneumatic chest compression is also useful in diagnostic procedures that measure the concentration of one or more exhaled gases. In one application, the measurement of nitric oxide indicates the extent of inflamed tissue in the airway of patients with various disease states. Such measurements are very precise and minute, with concentration levels in parts per billion. The concentrations of the gases are flow and pressure dependent; consequently, a specific and constant exhalation rate and pressure is desirable while performing such measurements. Therefore, there is a need for a chest compression system that operates to maintain constant exhaled air flows and pressures. This system should include a fast response control loop linked to a real time flow and pressure monitor in a patient's mouth.

Additionally, pneumatic chest compression may be useful in a diagnostic system for determining the condition of airways in patients with respiratory problems. For example, airways can be restricted by the effects of mucous build-up, muscle spasms, or inflammation. The pattern of air flow in a patient's mouth can be measured in response to a cycle of precise pressure variations on the chest wall. By accurately maintaining chest pressure variations, any variations in air flow at the patient's mouth are the result of changes in the restriction of the airways. To further identify the cause of the airway restriction, a broncho-dilator is used to determine if muscle spasm is causing the airway restriction. Additionally, a mucous mobilization mode is used to determine if mucous is causing the restriction.

Further, pneumatic chest compression may improve the efficiency, speed, and/or depth of deposition of aerosol medications used in respiratory treatment. For example, a high frequency chest wall compression pattern in combination with a controlled flow rate of inhalation and exhalation may produce improved aerosol deposition.

Consequently, there is a need for a single, multi-function pneumatic chest compression system that can provide the variable types and patterns of chest compressions described above, as well as perform, or operate with other devices that perform, the various related functions (e.g., detecting inhalation and exhalation) described above. Such a system would be particularly useful in a clinical environment for both diagnostic and treatment applications, but could also be used in a long-term treatment environment.

In addition to the multiple functions described above, a chest compression device should be safe to operate. Any type of unexpected or uncontrolled increase in chest compression could injure a patient or deter use of the device. This is particularly true concerning patients with a respiratory ailment where the ability to recover from such increased chest compressions may be limited or more difficult. Consequently, a chest compression system should limit, if not eliminate, the possibility of unintended or uncontrolled increases in chest compression.

SUMMARY OF THE INVENTION

The present invention is directed toward a multi-function air flow generator. The air flow generator includes an air amplifier having a pressurized air inlet, an ambient air inlet, and an air outlet. A first valve has an inlet for receiving pressurized air and an outlet that is operably coupled with the air amplifier pressurized air inlet. Means for selectively actuating the valve are provided to produce a preselected flow of pressurized air into the air amplifier pressurized air inlet, wherein the preselected flow of pressurized air into the air amplifier pressurized air inlet generates a predetermined flow of air through the air amplifier outlet. In one embodiment, the air amplifier comprises a coanda-effect air amplifier. Further, an acoustic silencing device may be operably coupled with the ambient air inlet of the air amplifier.

Additionally, an air bladder is operably coupled with the air amplifier outlet. An air storage tank having an inlet for receiving pressurized air and an outlet is operably connected with the first valve. A second valve having an inlet for receiving pressurized air and an outlet is operably coupled with the inlet of the storage tank. A feedback means is operably coupled with the bladder and with the means for selectively actuating, for detecting the air pressure in the bladder.

A first input for selecting a desired preselected air flow through the air amplifier outlet is operably coupled with the means for selectively actuating. A second input for selecting a desired frequency of preselected air flow through the air amplifier outlet is operably coupled with the means for selectively actuating. A third input for selecting a maximum air pressure through the air amplifier outlet is operably coupled with the means for selectively actuating. A fourth input for selecting a minimum air pressure through the air amplifier outlet is operably coupled with the means for selectively actuating. A fifth input for selecting a treatment function for which the air flow is generated is operably coupled with the means for selectively actuating.

A pneumatic on/off switch is operably coupled with the means for selectively actuating. Means for identifying inhalation and exhalation, are operably coupled with the means for selectively actuating. Means for measuring air pressure are operably coupled with means for selectively actuating.

The present invention provides several advantages. First, the invention is inherently safe. The invention has no failure mode where the air pressure delivered to a bladder positioned about a patient may be increased, accidentally or intentionally, to an unsafe level. Also, the invention is highly reliable, as the air flow generator has no moving parts to degrade or fail. Further, the air flow generator is lightweight, relatively small, low cost, and quiet. Finally, the present invention provides a single, multi-functional device, capable of performing a range of applications, with the ability to control the parameters within an application. Such a device not only provides great flexibility for healthcare facilities, but also reduces the cost of diagnosis and treatment as compared to multiple, separate systems needed to provide the same functionality.

DETAILED DESCRIPTION OF THE EMBODIMENTS

Figure 1:
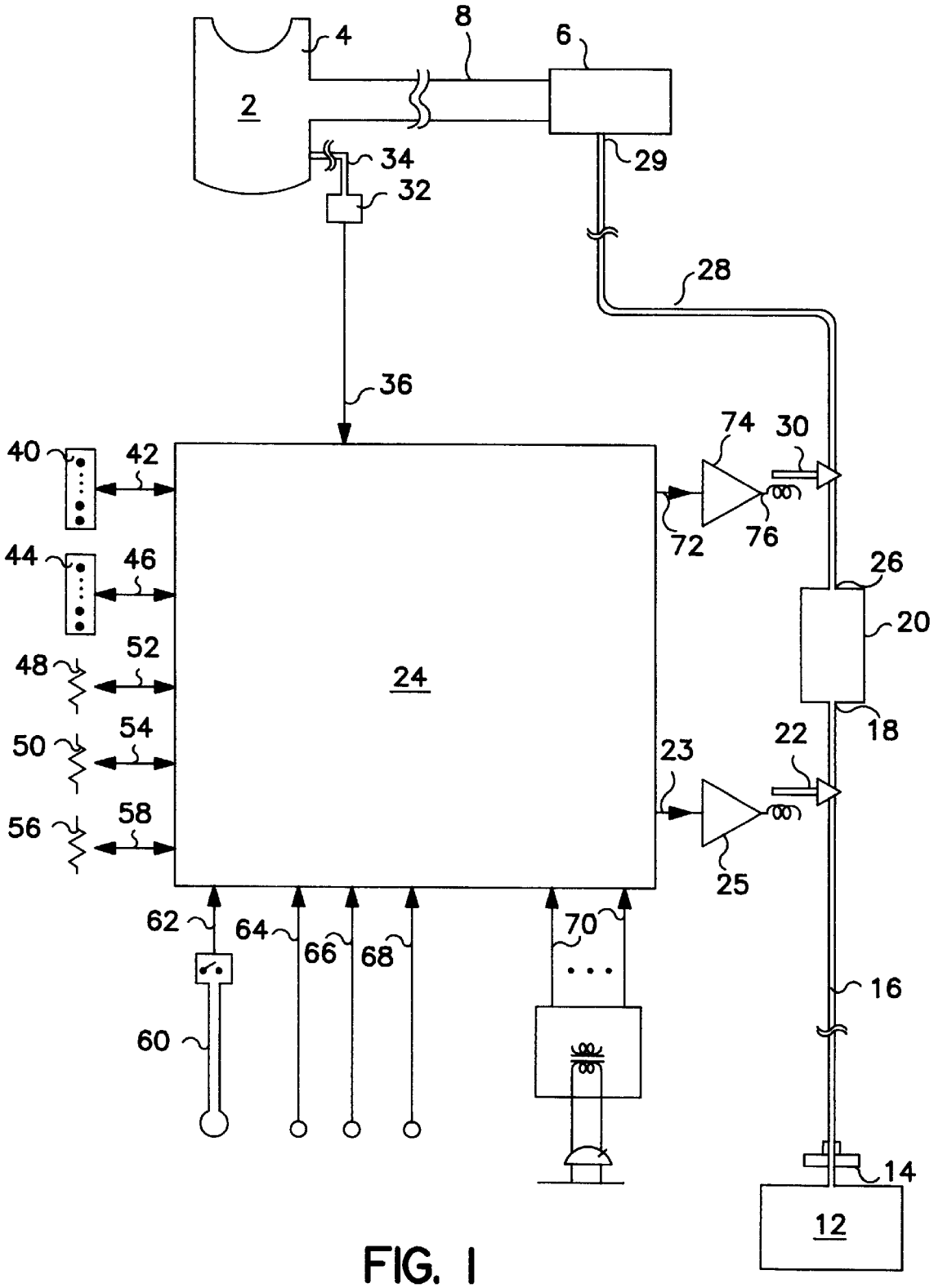
FIG. 1 is a block diagram of a pneumatic chest compression system.

One embodiment of the invention is shown in FIG. 1. An air bladder 2 is positioned about the chest of a patient so that the inner surface of bladder 2 is in contact with the patient's chest. The patient may be a human or other animal. Air bladder 2 may be contained within a nylon vest 4 or other suitable means to hold the bladder in place about the patient's chest. One example of a bladder/vest is the Model 103 Thairapy Vest, available from American Biosystems, Inc., St. Paul, Minn., assignee of the present invention. In clinical applications, it may be advantageous for bladder 2 to be disposable or repeatedly sterilizable.

Bladder 2 is connected to air flow generator 6 by at least one flexible hose 8. Hose 8 may be made from any suitable material. In one embodiment, hose 8 has a diameter of about 1.25 inches. Hose 8 may be relatively long, e.g., several feet, in a configuration where air flow generator 6 is fixedly positioned in a treatment area, or hose 8 may be as short as a few inches or less in configurations where air flow generator 6 is coupled directly to vest 4.

Figure 2:
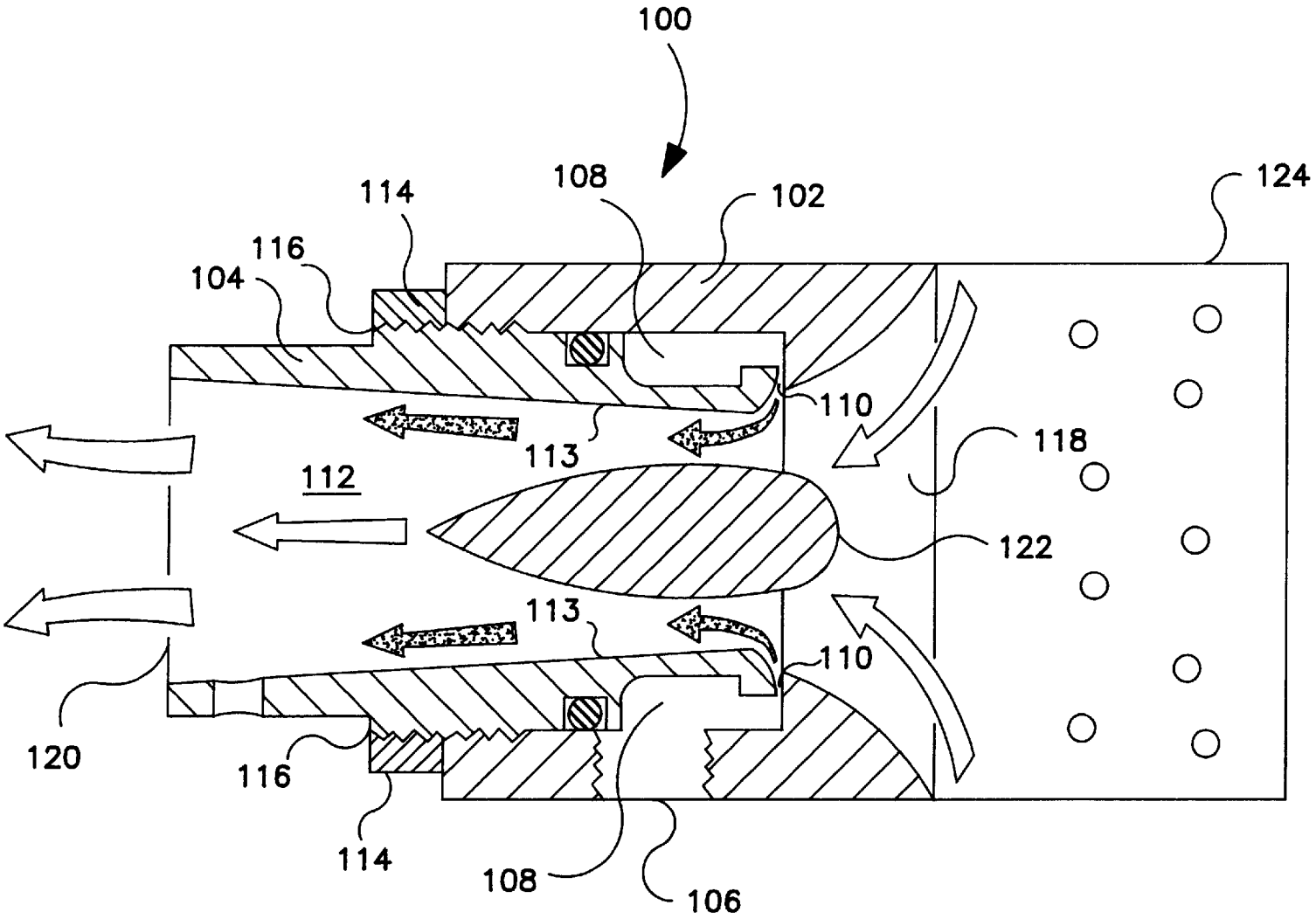
FIG. 2 is a cross-sectional side view of an air amplifier.

In the embodiment of FIG. 1, air flow generator 6 is an air amplifier. One suitable air amplifier is shown in FIG. 2 at 100. Air amplifier 100 is a coanda effect device. One example of a coanda effect air amplifier is the Model 6041 EXAIR-Amplifier, sold by EXAIR Corporation, Cincinnati, Ohio. Air amplifier 100 includes an outer housing 102 and inner housing 104. A first inlet 106 receives pressurized air into circular chamber 108. The pressurized air then passes through circular nozzle 110 into Venturi chamber 112, defined by the inner surface 113 of inner housing 104. Nozzle 110 is defined by the circular gap between outer housing 102 and inner housing 104. In one embodiment, this gap is about 0.003 inches. The gap is adjustable by means of ring 114, which is coupled via threads 116 to inner housing 104. Rotating ring 114 moves inner housing 104 relative to outer housing 102, thereby changing the gap of nozzle 110.

The pressurized air passes through nozzle 110 into Venturi chamber 112 at near sonic speeds. According to the coanda effect, this air flow creates a vacuum, bringing ambient air into Venturi chamber 112 through ambient air inlet 118. The resultant air flow exiting air amplifier 100 through outlet 120 is the sum of the pressurized air through first inlet 106 and the induced ambient air flow through second inlet 118. In one embodiment, baffle 122 is positioned in Venturi chamber 112 in order to obtain a desired pressure and volume combination at outlet 120. In one embodiment, the maximum outlet pressure is about 1 PSI and the flow rate is about 30 CFM.

The passive nature and physical geometry of air amplifier 100 provides an intrinsically safe air flow generator. As long as the air supplied to the air amplifier does not exceed the design parameter (e.g., 50 PSI), there is no failure mode of air amplifier 100 that could cause an air pressure to be generated at outlet 120 which exceeds the designed upper limit (e.g., 1 PSI). Therefore, air amplifier 100 provides a very safe design for an air flow generator. Further, air amplifier 100 provides the advantages of a smaller, lighter, quieter, more reliable, and less expensive implementation when compared to other air flow generating systems, including blowers, motors, oscillating diaphragms, and other systems.

As shown in the embodiment of FIG. 2, acoustic silencing device 124 (i.e., a muffler) is coupled with second inlet 118 in order to reduce the overall noise generated by air amplifier 100.

Referring again to FIG. 1, a pressurized air source 12 is provided. In a clinical environment, such as a hospital, a pressurized air source, typically 50 PSI, is provided throughout the facility via a highly regulated system with numerous safety features to ensure that the system pressure is closely controlled. A treatment room or patient room typically has at least one pressurized air outlet. A connector 14 is coupled with pressurized air source 12. Hose 16 couples connector 14 with inlet 18 of supply tank 20. On/off valve 22 is connected with hose 16 and controls the flow of pressurized air into supply tank 20. In one embodiment, valve 22 is an electric solenoid valve that is operated through controller 24, discussed further below. The opening and closing of valve 22 is controlled by a signal generated by controller 24 that passes on line 23 into amplifier 25, the output of which activates valve 22.

Outlet 26 of supply tank 20 connects with hose 28, which extends to a first inlet 29 of air flow generator 6, e.g., first inlet 106 of air amplifier 100. A second valve 30, also controlled by controller 24, is positioned on hose 28 intermediate outlet 26 and air flow generator 6. By manipulating valve 30, the flow of pressurized air into air flow generator 6 is controlled to produce a predetermined air flow out of air flow generator 6, e.g., outlet 120 of air amplifier 100, as discussed further below. In another embodiment, a supply tank is not used, and hose 16 couples directly with hose 28.

A feedback system includes a transducer 32 coupled with bladder 2 by hose 34. The air pressure in bladder 2 is measured and converted by transducer 32 into an electrical signal and sent to controller 24 by line 36. Controller 24 then processes this information to manipulate valve 30 to generate the desired air flow in bladder 2.

As shown in FIG. 1, various user interface and input connections are associated with controller 24. Function selection input 40 is connected with controller 24 via line 42. The person operating the system uses input 40 to select the function that the system is to be used for, e.g., mucous mobilization, breathing assist, exhaled gas composition analysis, etc. Waveform selector input 44 is connected with controller 24 via line 46, and is used to select the desired air flow waveform. For example, for mucous mobilization an oscillating waveform may be desirable, e.g., a sinusoidal waveform of about 20 Hertz and amplitude limits between 0.5 and 1 PSI. In a breathing assist function, a sawtooth waveform may be desirable.

Vest pressure minimums and maximums are selected using inputs 48 and 50, connected with controller 24 via lines 52 and 54, respectively. Waveform frequency is selected using input 56, connected with controller 24 via line 58. These input devices may be analog, e.g., potentiometers as shown in FIG. 1, or digital components. In another embodiment, one or more of the inputs may be combined into a single component, depending on the specific design parameters and cost and space considerations.

A pneumatic footswitch, 60, is coupled to controller 24 via line 62. Footswitch 60 may be used by the attending physician or other healthcare provider as an emergency on/off switch, thereby providing an additional safety feature.

Input connections 64 and 66 are available to receive signals indicating a monitored patient's inhalation and exhalation, respectively. Such respiratory detection devices are known. Input connection 68 receives signals from a device for monitoring air pressure and/or airflow from the mouth of a patient. Lines 70 provide power from an external power supply, e.g., 110 volt AC power.

Controller 24 may be built from analog components, digital components, or a combination thereof, as one of skill in the art will readily recognize. Digital components may include a microcontroller with associated software to perform the desired functionality.

Using air amplifier 100 and valve 30 (controlled by controller 24) results in a system that is highly reliable with fast response times. In one embodiment, valve 30 is an electric solenoid valve that provides a continuously variable range of air flow restriction between the fully closed and fully open positions. Suitable types of valves include stepper-driven valves, magnetic flapper valves, and cone-driven valves. Air passes from tank 20 into first inlet 106 at a rate that is dependent upon the degree of opening of valve 30. In one embodiment, valve 30 has a response time of about 4 milliseconds, allowing valve 30 to impart rapid changes in the flow of air passing through it in either a repetitious, oscillating pattern or non-repetitious pattern with rapid flow variations.

In operation, the modulated air flow from valve 30 passes into first inlet 106, producing a flow at outlet 120, base on the coanda effect. The modulated air flows through tube 8 into bladder 2. This flow continues until the air pressure out of outlet 120 is equal to the pressure inside bladder 2. When the pressure into inlet 106 is reduced from a previous higher level, the resultant pressure at outlet 120 drops to a lower level and air flows in the opposite direction, from bladder 2 through tube 8, through air amplifier 100, exiting at second inlet 118, until the bladder pressure and air amplifier pressure are equal. Consequently, pressure generated at outlet 120 is continuously variable as a non-linear function of the degree of opening of valve 30. In one embodiment, the pressure in bladder 2 can only vary in a range from zero to one PSI, assuming air supply 12 does not exceed 50 PSI. There are no failure modes of valve 30 and air amplifier 100 that can increase this pressure range, yielding an intrinsically safe device with respect to chest pressure.

As described above, varying the degree of opening of valve 30 varies the pressure in bladder 2 and, consequently, on the chest of a patient. The degree of opening of valve 30 is controlled by signals generated at controller 24 and conveyed to valve 30 through line 72, amplifier 74, and line 76. Therefore, the air flows generated by air amplifier 100 and passed into bladder 2, are the result of signals conveyed from controller 24 to valve 30. These signals represent time variant patterns of air flows or pulses, depending upon the desired functional mode selected at input 40.

For example, the mucous mobilization function corresponds to a setting at input 40. Controller 24 produces a continuous oscillating signal pattern (e.g., voltage) at 72 with a frequency that corresponds to the setting of input 56. The bladder 2 pressure does not respond linearly to voltages produced at 72, therefore, controller 24 adds a fixed pattern of correction factors to the voltage so that the bladder pressure wave shape closely approximates the selected wave shape. For example, delays due to the speed of sound through hoses 28 and 8 cause too much lag and instability in the loop to allow control of oscillating waves in the 20 Hz range, typical of the mucous mobilization function.

Pressure sensor 32 in the feedback loop senses the bladder pressure and converts it to a proportional signal (e.g., voltage), which is received by controller 24. The bladder pressures minimums and maximums are sampled and saved during each cycle and compared to the minimum and maximum values selected at inputs 48 and 50. Controller 24 adjusts the high and low values of the voltage pattern at 72 until the bladder pressure minimums and maximums agree with the settings of inputs 48 and 50. Only the pressure minimums and maximums are maintained by this closed feedback loop. The overall wave shape is maintained by the open loop correction described above.

When an assisted breathing function is selected at input 40, controller 24 monitors inputs 64 and 66 to detect the breathing cycle. As described above, an external breathing monitor (e.g., a pneumotach) monitors the patient's inhalation and exhalation and provides signals at 64 and 66, which indicate the beginning of each breathing half-cycle, i.e., inhalation and exhalation. When input 66 becomes active, controller 24 generates voltage signals to manipulate valve 30 to produces a pressure pattern in bladder 2. This pressure pattern is measured by pressure sensor 32 and conveyed to controller 24 where it is compared to a pattern stored in memory associated with controller 24 and selected by the setting of input 44. For breathing assist, this is a slowly changing pressure pattern that essentially increases to a maximum value then decreases to zero extending over most of a normal exhalation cycle. For this application the bladder pressure pattern is continuously compared to the selected pressure pattern and an error signal is generated that provides a correction factor at output 72 as in a typical closed loop control system.

It is desirable that the chest pressure return to near zero before the patient begins to inhale. The external breathing monitor provides a signal at 64 that indicate the beginning of inhalation. Controller 24 monitors this signal and adjusts the time span of the pressure pulse so that successive pulses are made longer or shorter to better fit within exhalation cycles to follow based on the measured length of previous breathing cycles. The amplitude of the pressure cycle is selected by input 56.

When the invention is used to produce metered flows and pressures of exhaled gas for gas composition analysis, input 40 is set to indicate this mode and an external device is connected to controller 24 through connection 68. The external device monitors pressure and/or flow at the mouth of a patient and provides a signal proportional to the measured value at connection 68. An external device also monitors inhalation and exhalation as in the assisted breathing discussion above. The desired flow at the mouth is set at input 48. When the patient begins to exhale it is indicated by an active signal at connection 66. The controller 24 compares the measured exhalation input at 68 to the desired setting at input 48. Controller 24 increases the voltage at 72 and the pressure in the bladder is increased until the desired and measured values agree.

Combinations of these functions can also be provided by this invention such as high frequency oscillation superimposed on breathing assist, thereby allowing mucous mobilization to proceed concurrent with assisted breathing, yielding enhanced gas exchange in the lungs resulting from the turbulence effects of the oscillations. In other embodiments, other gases and/or combinations of gases may be used instead of air. For example, clinical environments typically have a highly regulated supply of oxygen. This oxygen supply could be connected at connector 14 and used as the gas supply.

Other embodiments are within the scope of the following claims.

We claim the following:

1. A multi-function air flow generator generating air in a bladder, comprising:

an air amplifier having a pressurized air inlet, an ambient air inlet, and an air outlet;

a first valve having an inlet for receiving pressurized air and an outlet operably coupled with the air amplifier pressurized air inlet;

means for selectively actuating the valve to produce a preselected flow of pressurized air into the air amplifier pressurized air inlet, wherein the preselected flow of pressurized air into the air amplifier pressurized air inlet generates a predetermined flow of air through the air amplifier outlet; and means for periodically sampling an air pressure in the bladder adapted to be positioned about a subject, the bladder operably connected with the air outlet, and the sampling means operably connected with the means for selectively actuating.

2. The apparatus of claim 1, wherein the air amplifier comprises a coanda-effect air amplifier.

3. The apparatus of claim 1, further comprising an acoustic silencing device operably coupled with the ambient air inlet.

4. The apparatus of claim 1, further comprising an air storage tank having an inlet for receiving pressurized air and an outlet operably connected with the first valve.

5. The apparatus of claim 4, further comprising a second valve having an inlet for receiving pressurized air and an outlet operably coupled with the inlet of the storage tank.

6. The apparatus of claim 1, further comprising means for selecting a desired preselected air flow through the air amplifier outlet, operably coupled with the means for selectively actuating.

7. The apparatus of claim 1, further comprising means for selecting a desired frequency of preselected air flow through the air amplifier outlet, operably coupled with the means for selectively actuating.

8. The apparatus of claim 1, further comprising means for selecting a maximum air pressure through the air amplifier outlet, operably coupled with the means for selectively actuating.

9. The apparatus of claim 1, further comprising means for selecting a minimum air pressure through the air amplifier outlet, operably coupled with the means for selectively actuating.

10. The apparatus of claim 1, further comprising means for selecting a predetermined type of treatment for which the air flow is generated, operably coupled with the means for selectively actuating.

11. The apparatus of claim 1, further comprising a pneumatic on/off switch operably coupled with the means for selectively actuating.

12. The apparatus of claim 1, further comprising means for identifying inhalation and exhalation, operably coupled with the means for selectively actuating.

13. An apparatus for generating air pulses in a bladder, comprising:

a bladder;

an air amplifier having a first inlet, a second inlet, and an outlet;

a first valve having an inlet for receiving pressurized air and an outlet operably coupled with the first inlet;

a valve actuating circuit operably coupled with the first valve, wherein the valve actuating circuit selectively actuates the valve, producing a preselected flow of air through the air amplifier outlet; and a sampling circuit operably connected with the bladder adapted to be positioned about a subject and the valve actuating circuit, the bladder operably coupled with the outlet, wherein the sampling circuit samples a pressure in the bladder.

14. The apparatus of claim 13, wherein the air amplifier comprises a coanda-effect air amplifier.

15. The apparatus of claim 13, further comprising an air storage tank having an inlet for receiving pressurized air and an outlet operably connected with the first valve.

16. The apparatus of claim 13, further comprising means for selecting a desired preselected air flow through the air amplifier outlet, operably coupled with the valve actuating circuit.

17. The apparatus of claim 13, further comprising means for selecting a desired frequency of preselected air flow through the air amplifier outlet, operably coupled with the valve actuating circuit.

18. The apparatus of claim 13, further comprising means for selecting a maximum air pressure through the air amplifier outlet, operably coupled with the valve actuating circuit.

19. The apparatus of claim 13, further comprising means for selecting a minimum air pressure through the air amplifier outlet, operably coupled with the valve actuating circuit.

20. The apparatus of claim 13, further comprising means for selecting a treatment function for which the air flow is generated, operably coupled with the valve actuating circuit.

21. The apparatus of claim 13, further comprising a pneumatic on/off switch operably coupled with the valve actuating circuit.

22. The apparatus of claim 13, further comprising means for identifying inhalation and exhalation, operably coupled with the valve actuating circuit.

* * * * *